US007543535B2

(12) United States Patent
Herrlinger

(10) Patent No.: US 7,543,535 B2
(45) Date of Patent: Jun. 9, 2009

(54) RIFLE BULLET FOR HUNTING PURPOSES

(75) Inventor: Klaus Herrlinger, Bad Uberkingen (DE)

(73) Assignee: Wilhelm Brenneke GmbH & Co. KG, Langenhagen (DE)

( * ) Notice: Subject to any disclaimer, the term of this patent is extended or adjusted under 35 U.S.C. 154(b) by 674 days.

(21) Appl. No.: 11/148,305

(22) Filed: Jun. 9, 2005

(65) Prior Publication Data

US 2007/0006770 A1 Jan. 11, 2007

Related U.S. Application Data

(63) Continuation of application No. PCT/DE03/04028, filed on Dec. 4, 2003.

(30) Foreign Application Priority Data

Dec. 9, 2002 (DE) ..... 102 57 590

(51) Int. Cl.
*F42B 30/00* (2006.01)

(52) U.S. Cl. ..... 102/514; 102/516

(58) Field of Classification Search ..... 102/514, 102/516

See application file for complete search history.

(56) References Cited

U.S. PATENT DOCUMENTS 2,321,344 A * 6/1943 Whipple ..... 102/509
2,333,091 A 11/1943 Crasnoff
3,142,256 A * 7/1964 Mack ..... 102/514
3,349,711 A * 10/1967 Darigo et al. ..... 102/509
3,442,216 A * 5/1969 Niemann et al. ..... 102/514
4,517,897 A * 5/1985 Kneubuhl ..... 102/439
4,856,160 A * 8/1989 Habbe et al. ..... 86/55
5,357,866 A * 10/1994 Schluckebier et al. ..... 102/509
5,686,693 A * 11/1997 Jakobsson ..... 102/501
5,794,320 A * 8/1998 Wernz et al. ..... 86/55

(Continued)

FOREIGN PATENT DOCUMENTS

DE 583 097 8/1933

(Continued)

OTHER PUBLICATIONS

International Search Report, dated Apr. 21, 2004, in International Application No. PCT/DE2003/04028 filed Dec. 4, 2003 (2 pages) (in English).

*Primary Examiner*—Michael Carone
*Assistant Examiner*—Samir Abdosh
(74) *Attorney, Agent, or Firm*—Shlesinger, Arkwright & Garvey LLP

(57) ABSTRACT

Rifle bullet for hunting purposes, with a jacket of a lead-free soft ductile material and a core, connected to the jacket, made from a material softer than the jacket. The aim of the invention is to improve the bullet to provide a persistent cut of hair and bleeding at the point of entry, mushrooming in a controlled manner with considerable cross-sectional enlargement, whilst only marginally breaking up with a high residual weight (90% and more). The rifle bullet has a thinly-jacketed bullet tip and has a marked sharp edge at the transition point of the jacket on the bullet tip to a substantially thicker-jacketed tail section. The rifle bullet is internally provided with a circumferential channel reducing the wall thickness of the jacket at said point, filled with the core material.

14 Claims, 1 Drawing Sheet

U.S. PATENT DOCUMENTS

| | | | | |
|---|---|---|---|---|
| 6,213,022 | B1 * | 4/2001 | Pullum | 102/439 |
| 6,439,124 | B1 * | 8/2002 | Enlow et al. | 102/501 |
| 6,973,879 | B1 * | 12/2005 | McElroy et al. | 102/514 |
| 2005/0183617 | A1 * | 8/2005 | MacDougall | 102/514 |

FOREIGN PATENT DOCUMENTS

| | | | |
|---|---|---|---|
| DE | 2 223 212 | | 11/1973 |
| DE | 38 40 165 | A1 | 7/1990 |
| DE | 41 30 455 | C2 | 3/1993 |
| DE | 100 42 711 | A1 | 3/2001 |
| DE | 100 45 009 | A1 | 5/2001 |
| EP | 0 225 532 | A1 | 6/1987 |
| EP | 225532 | A1 * | 6/1987 |
| EP | 0 918 208 | A1 | 5/1999 |
| FR | 764 833 | A | 5/1934 |
| GB | 953557 | | 3/1964 |
| WO | 2004/053423 | A1 | 6/2004 |

* cited by examiner

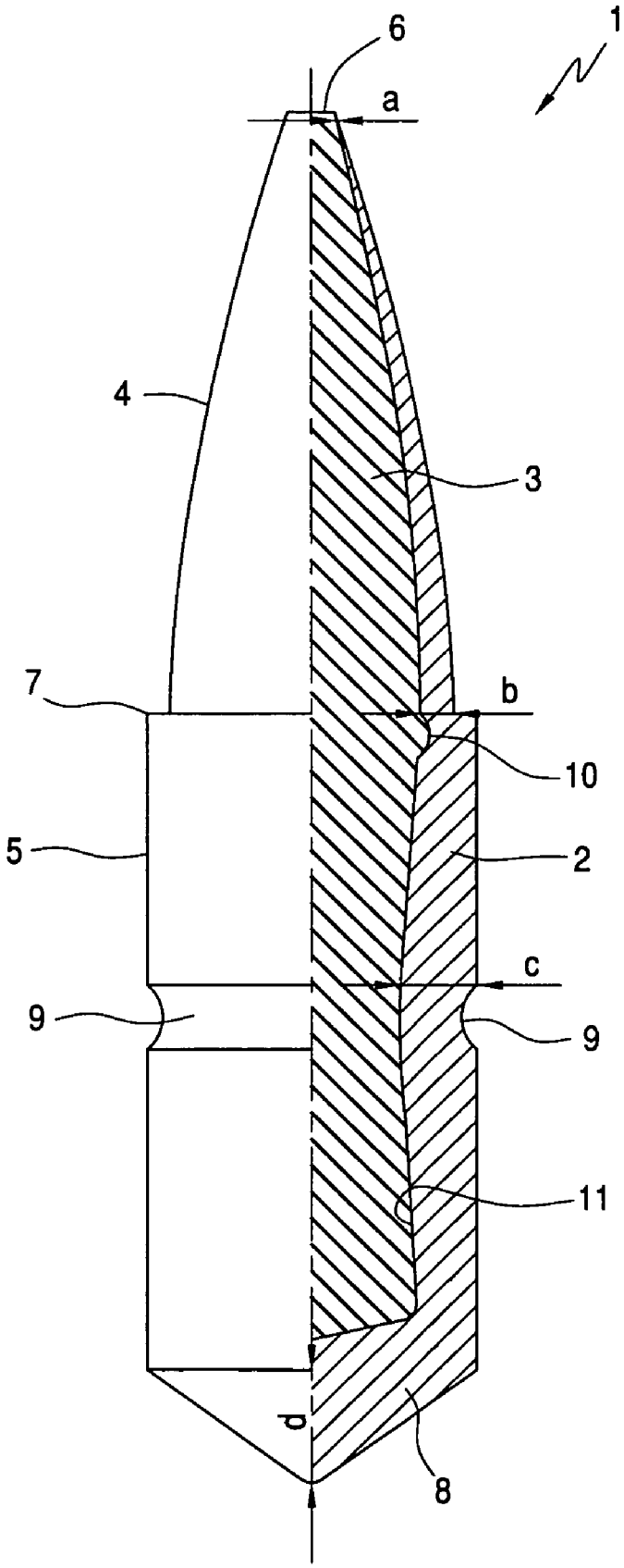
1
6
a
4
3
7
b
10
5
2
c
9
9
11
d
8

RIFLE BULLET FOR HUNTING PURPOSES

CROSS-REFERENCE TO RELATED APPLICATION

This application is a continuation of U.S. application no. PCT/DE2003/004028, filed Dec. 4, 2003, which claims the priority of German application no. 102 57 590.8, filed Dec. 9, 2002, and each of which is incorporated herein by reference.

FIELD OF THE INVENTION

The present invention relates to a hunting rifle bullet with a jacket made of a lead-free, ductile material and a core bonded to the jacket. The core is made of a material softer than that of the jacket.

BACKGROUND OF THE INVENTION

Modern rifle bullets must sufficiently meet the various requirements of hunting. The most important of these requirements is target accuracy, that is, bullets must ensure shooting precision from various hunting firearms. Furthermore, the target should be killed with as little suffering as possible. For these reasons a good cross-sectional expansion and penetration of the bullet in the target is necessary. To fulfill these requirements, the bullet must simultaneously increase in cross section and lose as little weight as possible to fragmentation upon entering the target. An additional requirement for modern rifle bullets is that they cause clearing of hair and bleeding at the entry wound to make any potential pursuit easier even in the absence of an exit wound.

Because the entry wound frequently closes very quickly due to the elasticity of the coat, the hide, and the underlying layer of fat, an exit wound with bleeding is desirable even when a shot is made at an unfavorable angle.

These requirements posed by hunting are well satisfied by the rifle bullets developed by Brenneke GmbH (D-30851 Langenhagen, Germany) and known worldwide under the brand names TUG™ (Torpedo-Universal-Bullet) and TIG™ (Torpedo-Ideal-Bullet). These bullets constitute jacketed hollow point bullets with nickel-plated mild steel jackets which are formfitting around dual lead cores consisting of a forward, soft lead core and of an aft, hard lead core. The brand names denote the torpedo-shaped bases found in these bullets.

This base form has certain advantages in terms of interior ballistics. The dual core construction of the Brenneke rifle bullets mentioned above facilitates an optimal energy transfer in the target with reliable expansion and penetration. This results in the very rapid deformation of the soft, forward lead core, which is slowed by the harder, aft lead core and the gradually increasing thickness of both the bullet jacket and of the necking region in the tail. Upon entering the target, these bullets may partially fragment.

However, the hard, aft lead core results in the desired exit wound in most cases.

Characteristic of the TIG and TUG-bullets is a sharp edge formed behind the bullet tip, which in most cases causes cut hair and bleeding at the entry wound.

Another jacketed hollow point bullet with a dual core is described in EP 0 225 532 A1. The aft core is made of lead and is partly surrounded by an inner jacket. The aft core is held together with the inner jacket through the radial impression of the outer jacket on the inner jacket. The aft core is made of lead, while the forward core can be made of lead or a lead-free material such as zinc, tin, or copper to prevent lead-contamination of the target. No claims are made regarding the material of the outer jacket. The bond between the cores and both the inner and outer jackets is provided through a form fit. Furthermore, the bullet is characterized by a hollow point, which functions to accelerate the mushrooming.

When hitting the target, the tip first exhibits outward radial expansion before rearward folding. The forward region of the aft lead core is thereby strongly compressed, whereby the core together with the inner jacket exhibits strong outward radial expansion. A mechanical bond thereby occurs involving the aft core, the inner jacket, and the outer jacket.

The aft core therefore remains tightly bonded to the mushroomed outer jacket. When the outer jacket mushrooms, the radial indentation forms a barrier against further mushrooming due to its increased resistance moment.

Because that rifle bullet does not have a sharp edge, it ensures neither clearing of hair nor bleeding at the entry wound. Furthermore, that bullet partly fragments in the target simply upon displacement of the forward core. As a result, that bullet loses mass and an exit wound, at least in cases of unfavorable angle of shot, is not ensured.

In DE 38 40 165 A1 a lead-free rifle bullet is described that is also a jacketed hollow point bullet. The jacket is made of red brass or mild steel. It can be closed at the aft region, that is, at the base, or it can rest as a nipple on the bullet core. The bond between jacket and bullet core is formed through material bonding, e.g. through soldering or through the introduction of a channel in the outer jacket, which is pressed into the bullet core. The forward edge of the jacket extends radially outwardly of the bullet core, and can be configured as a sharp edge.

OBJECTS AND SUMMARY OF THE INVENTION

An object of the present invention is to produce a hunting rifle bullet with a lead core and jacketed hollow point, which ensures lasting clearing of hair and bleeding at the entry wound, exhibits controlled mushrooming with a significant crosssectional expansion, experiences only minor fragmentation, and has a high residual weight (90% and upward).

This object has been achieved in accordance with the invention by a rifle bullet for a hunting rifle with a jacket made of a lead-free, ductile material such as red brass, copper or brass and a core physically connected to the jacket and made of a material softer than that of the jacket, such as lead, a lead-tin alloy or a lead-free bismuth alloy. The rifle bullet includes a thinly jacketed bullet head and at a portion of the jacket where the bullet head meets the significantly thicker-walled tail section the rifle bullet features both a prominent sharp edge and, inwardly thereof, a circumferential groove engaging the wall of the jacket and filled with the material of the core.

Upon entering the target, the hollow point triggers a rapid initiation of the deformation of the rifle bullet starting at the bullet tip. At that time, in the region of the sharp edge, the inner groove filled with the soft core, and which groove reduces the inner side of the wall thickness of the jacket, acts as a shock absorber by absorbing the strong axial forces on the bullet resulting from its hitting the target, so that the bullet head does not suddenly tear open, but instead exhibits controlled mushrooming. As a result all mushroom scrolls curl essentially evenly, wherein the bullet core also tears open as a result of the metallurgical bond with the bullet jacket. Unlike that of a bullet of the prior art, the bullet core does not significantly separate from the jacket. As a result the inventive bullet unit remains essentially intact in the target. No more than 10% of the bullet is separated as fragments.

Because the mushrooming scrolls curl essentially evenly, that is, the bullet deforms essentially evenly in the target material, an unpredictable change of direction in the body of the target is therefore prevented.

Because the mass of the bullet remains mostly intact, the bullet ensures deep penetration into the target and can be expected to leave an exit wound if the shot enters at a normal angle.

The junction between the bullet nose and the sharp edge in rifle bullets is generally at a right angle, that is, it exhibits very sharp edges. As a result, there is always the danger of curled mushrooming scrolls breaking off, which in the prior art meant that the sharp edge was always of relatively weak construction. Because of the groove on the inside in the region of the sharp edge of the inventive bullet and the shock-absorbent effect thereof, which has already been described, the sharp edge in the inventive bullet can be more prominent than that found in the prior art. Owing to this feature, the inventive rifle bullet produces a circular opening at the exit wound, which as a rule prevents closure of the entry wound and facilitates sufficient clearing of hair.

Through the optional use of a bullet core made of a lead-free bismuth alloy having nearly the same specific density as lead, a completely lead-free rifle bullet can be produced without having to sacrifice the optimal bullet length for bullet weight of each caliber range.

In further embodiments of the invention a circumferential cannelure is present in the middle region of the jacket of the tail. This feature provides cold hardening of jacket which is already comparatively stronger than that of the prior art. This embodiment, together with the material bond between jacket and core, ensures that the mushrooming of the bullet cannot extend past the cannelure. The gradual increase of jacket thickness in the region between the sharp edge and the cannelure also contributes to this effect.

In another embodiment of the rifle bullet the outer diameter in the region between the base and the cannelure is equal to the barrel caliber, while the outer diameter in the region between the cannelure and the sharp edge is slightly tapered to restrict the sharp edge from engaging the rifling of a rifle barrel during firing. Despite this configuration, the cylindrical segment of the bullet between the base and the cannelure serving as the guiding component in the barrel is of sufficient length. At the same time, damage to the sharp edge during passage through the barrel is prevented.

In a further embodiment of the invention, the base of the bullet is thick-walled. Its thickness is significantly greater than the thickness of the wall of the likewise thick-walled bullet jacket of the tail region. The thick-walled bullet base should prevent or reduce the negative effects of the propulsion gasses developed on firing from acting upon the bullet core, and should also stabilize the form of the guiding part of the bullet when penetrating the target.

It is advantageous in regard to interior ballistics if the rifle bullet has a spherical base, which is a feature also found in the TIG™ and TUG™ bullets previously described.

An embodiment of the invention is described in further detail below.

Relative terms such as up, down, left, and right are for convenience only and are not intended to be limiting.

BRIEF DESCRIPTION OF THE DRAWING

The single FIGURE shows a rifle bullet in side view with a cutaway of the right side of the drawing.

DETAILED DESCRIPTION OF THE INVENTION

Inventive bullet 1 is configured as a jacketed hollow point bullet. It includes a red brass jacket 2 and a lead core 3. A lead-free bismuth alloy can be used in place of lead, if a lead-free bullet is desired.

For the purpose of clarity in the following description the rifle bullet is divided into a bullet head 4 and a tail section 5, wherein the bullet head 4 is provided between a bullet tip 6 and a sharp edge 7, and the tail section 5 is provided between said sharp edge 7 and a bullet base 8. The bullet tip 6 is configured as a hollow tip.

The rifle bullet 1 jacket 2 is very thin-walled at the bullet tip 6 and becomes gradually thicker until reaching the sharp edge 7. In accordance with the caliber, wall thickness a is about 0.2-0.3 mm at the bullet tip 6, while wall-thickness b is about between 0.7-0.9 mm. The bullet head 4 is concave and thinner toward the hollow tip 6.

At the lower end of the nose 4 of the rifle bullet 1 sharp edge 7 divides the tail section 5 from the head 4. From sharp edge 7 the wall thickness of the jacket gradually increases up to a cannelure 9, which is a circumferentially running groove pressed midway down the tail 5. At the edge of cannelure 9 the wall thickness c of the jacket 2 is approximately 1.8 mm. The wall thickness from cannelure 9 rearwardly toward base 8 decreases again owing to manufacturing requirements.

The wall of the base 8 itself is very thick, measuring approximately 3 mm (wall thickness d) at its thickest point, and like the TIG and TUG is torpedo-shaped for improved interior ballistics.

At the junction between bullet head 4 and tail section 5 and on the inner side of the jacket is a circumferentially running groove 10 with a rounded cross section and that is filled with core material. The groove 10 acts at this point as a shock absorber when the rifle bullet 1 enters the target. This characteristic shall be described in further detail below. The shock absorbent groove 10 makes it possible to construct a relatively prominent sharp edge 7, that is, one with relatively high radial projection. In this case, as shown in the FIGURE, the sharp edge 7 projects outwardly from the foot of the bullet nose 4 by approximately 0.5 mm.

The bullet core 3 is mechanically bonded permanently to the jacket 2 in that the two components are soldered together with a tin alloy 11. During the production of the rifle bullet, tin alloy 11 is introduced as a paste between the lead core 3 and the red brass jacket 2 prior to the drawing process. The material bond between the lead bullet core 3 and red brass jacket 2 occurs after the rifle bullet 1 is subjected to heat treatment.

Owing to the construction of the rifle bullet 1 described above, the deformation occurring upon entry into the target is initiated at the bullet tip 6, with the jacket 2 tearing open to the sharp edge 7 or, when hitting harder target material such as bone, to the cannelure 9 at a maximum, wherein the bullet core 3 as well is torn open as a result of its permanent bond with the jacket 2. All resulting mushrooming scrolls curl relatively evenly, without the loss of any significant mass of fragments. This mushrooming results in an up to 2.7 fold enlargement of the bullet cross section.

Overall, less than 10% of the original weight of the rifle bullet 1 is lost to fragmentation following entry of the bullet into the target. The rifle bullet therefore has a very high residual weight in wild game, so that an exit wound can normally be expected despite the crosssectional expansion.

The prominent sharp edge 7 ensures both the cutting of hair and lasting bleeding at the entry wound.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

The invention claimed is:

1. Bullet for a hunting rifle, comprising:

a) a jacket made of a lead-free, ductile material, including red brass, copper, or brass, the jacket including a wall thickness;

b) a core physically connected to the jacket and made of a material softer than that of the jacket, including lead, a lead-tin alloy, or a lead-free bismuth alloy;

c) a thinly jacketed bullet head;

d) a tail section, the tail section being thicker walled than the thinly jacketed bullet head; and e) at a portion of the jacket where the bullet head meets the thicker-walled tail section the rifle bullet includes both a prominent sharp edge extending outwardly thereof and increasing the wall thickness of the jacket and, inwardly thereof, a circumferential groove reducing the wall thickness of the jacket and filled with the material of the core.

2. Rifle bullet as claimed in claim 1, wherein:

a) a middle region of the thickly-jacketed tail section includes a circumferentially running cannelure on the outside of the jacket.

3. Rifle bullet as claimed in claim 2, wherein:

a) the wall thickness of the jacket is gradually increased in the region between the groove and the cannelure.

4. Rifle bullet as claimed in claim 3, wherein:

a) the outer diameter in the region between a base and the cannelure is equal to a barrel caliber; and b) the outer diameter of the region between the cannelure and the sharp edge is gently tapered to prevent the sharp edge from engaging rifling of a rifle barrel.

5. Rifle bullet as claimed in claim 4, wherein:

a) the wall thickness of the base is significantly greater than the wall thickness of the jacket in the tail section.

6. Rifle bullet as claimed in claim 4, wherein:

a) the base is cone-shaped.

7. Bullet for a hunting rifle, comprising:

a) a jacket, the jacket including a wall having a wall thickness, and being made of a lead-free, ductile material;

b) a core physically connected to the jacket and made of a material softer than the material of the jacket;

c) a thinly jacketed bullet head jacketed by the wall;

d) a tail section jacketed by the wall, the tail section being thicker walled than the thinly jacketed bullet head; and e) at a portion of the jacket where the bullet head meets the thicker-walled tail section the rifle bullet includes both a prominent sharp edge extending outwardly thereof and increasing the wall thickness of the jacket and, inwardly thereof, a circumferential groove reducing the wall thickness of the jacket, and the circumferential groove being filled with the material of the core.

8. Rifle bullet as claimed in claim 7, wherein:

a) a middle region of the thickly-jacketed tail section includes a circumferentially running cannelure on the outside of the jacket.

9. Rifle bullet as claimed in claim 8, wherein:

a) the wall thickness of the jacket is gradually increased in the region between the groove and the cannelure.

10. Rifle bullet as claimed in claim 9, wherein:

a) the outer diameter in a region between a base and the cannelure is equal to a barrel caliber; and b) the outer diameter of a region between the cannelure and the sharp edge is gently tapered to prevent the sharp edge from engaging rifling of a rifle barrel.

11. Rifle bullet as claimed in claim 10, wherein:

a) a wall thickness of the base is significantly greater than that of the jacket in the tail section.

12. Rifle bullet as claimed in claim 11, wherein:

a) the base is coneshaped.

13. Rifle bullet as in claim 7, wherein:

a) the lead-free, ductile material includes one of red brass, copper, and brass; and b) the material of the core includes one of lead, a lead-tin alloy, and a lead-free bismuth alloy.

14. Rifle bullet as in claim 7, wherein:

a) the lead-free, ductile material includes one of red brass, copper, and brass; and b) the material of the core includes a lead-free bismuth alloy.

* * * * *